US006875133B2

(12) United States Patent
Iwami

(10) Patent No.: US 6,875,133 B2
(45) Date of Patent: Apr. 5, 2005

(54) GOLF BALL

(75) Inventor: Satoshi Iwami, Kobe (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 0 days.

(21) Appl. No.: 10/408,336

(22) Filed: Apr. 8, 2003

(65) Prior Publication Data

US 2004/0048693 A1 Mar. 11, 2004

(30) Foreign Application Priority Data

Apr. 8, 2002 (JP) ..... 2002/104931

(51) Int. Cl.[7] ..... A63B 37/06
(52) U.S. Cl. ..... 473/378
(58) Field of Search ..... 473/351, 377, 473/378

(56) References Cited

U.S. PATENT DOCUMENTS 4,884,814 A 12/1989 Sullivan
5,120,791 A 6/1992 Sullivan

FOREIGN PATENT DOCUMENTS

| | | | | |
|---|---|---|---|---|
| GB | 2278364 A | | 11/1994 | |
| JP | 5-3931 A | | 1/1993 | |
| JP | 6-299052 A | | 10/1994 | |
| JP | 06-299052 | * | 10/1994 | ..... A63B/37/00 |
| JP | 6-327794 A | | 11/1994 | |
| JP | 9-176429 A | | 7/1997 | |
| JP | 2709950 B2 | | 10/1997 | |

* cited by examiner

*Primary Examiner*—Raeann Gorden
(74) *Attorney, Agent, or Firm*—Birch, Stewart, Kolasch & Birch, LLP

(57) ABSTRACT

The present invention provides a golf ball, which is superior in shot feel, rebound characteristics and laminar separation resistance. The present invention relates to a golf ball comprising at least one layer of a core and a cover formed on the core, wherein the cover is formed from a cover resin composition mainly comprising a mixture of (a) ionomer resin, and (b) a functional group modified polyester-based thermoplastic elastomer as a base resin.

17 Claims, No Drawings

GOLF BALL

FIELD OF THE INVENTION

The present invention relates to a golf ball. More particularly, it relates to a golf ball, which is superior in shot feel, rebound characteristics and laminar separation resistance.

BACKGROUND OF THE INVENTION

Recently, ionomer resin has been widely used for cover material of golf balls. This is because the ionomer resin is superior in rebound characteristics, durability, processability and the like. However, since the ionomer resin has high rigidity and hardness, there are problems that in the resulting golf ball, shot feel is hard and poor; and spin performance is not sufficiently obtained, which degrades controllability, when using ionomer resin alone as the cover material.

In order to solve the problems, it is attempted to soften the ionomer resin by various means. For example, it is proposed to blend the hard ionomer resin having high rigidity with terpolymer-based soft ionomer resin (Japanese Patent Kokai Publications No. 3931/1993, Japanese Patent No. 2709950 and the like) or blend the hard ionomer resin with thermoplastic elastomer (Japanese Patent Kokai Publications Nos. 299052/1994, 327794/1994 and the like) to soften the cover.

However, when good shot feel and spin performance are accomplished in case of using the blend of the hard ionomer with the soft ionomer resin, rebound characteristics of the resulting golf bail are largely degraded. When the blend of the hard ionomer with the thermoplastic elastomer is used, rebound characteristics are excellent compared with the blend with the soft ionomer resin, but the compatibility between the both is poor, and durability is poor compared with the blend with the soft ionomer resin.

In order to solve the problems, it has been suggested to improve flexibility, rebound characteristics of golf ball and compatibility of cover material by using epoxidized diene block copolymer in addition to thermoplastic elastomer and ionomer resin as a cover material of golf ball (Japanese Patent Kokai publication No. 176429/1997 and the like). In Japanese Patent Kokai publication No. 176429/1997, thermoplastic resin composition comprising (A) from 20 to 90 parts by weight of thermoplastic elastomer selected from the group consisting of polyester-based thermoplastic elastomer and polyamide-based thermoplastic elastomer, (B) from 80 to 10 parts by weight of ethylene-based copolymer selected from the group consisting of ionomer of ethylene copolymer having unsaturated carboxylic acid or its anhydride, and ionomer thereof, and (C) from 1 to 30 parts by weight of epoxidized diene block copolymer, with a proviso that the sum of (A) and (B) is 100 parts by weight and golf ball produced from the thermoplastic resin composition are disclosed. Since the component (C) is epoxidized, the compatibility is improved compared with the blend of the ionomer resin with the thermoplastic elastomer, but the compatibility is not sufficiently obtained. Therefore, there is problem that laminar separation resistance of the resulting golf ball is poor.

OBJECTS OF THE INVENTION

A main object of the present invention is to provide a golf ball, which is superior in shot feel, rebound characteristics and laminar separation resistance.

According to the present invention, the object described above has been accomplished by using a mixture of ionomer resin and a functional group modified polyester-based thermoplastic elastomer as a base resin of the cover, thereby providing a golf ball, which is superior in shot feel, rebound characteristics and laminar separation resistance.

SUMMARY OF THE INVENTION

The present invention relates to a golf ball comprising at least one layer of a core and a cover formed on the core, wherein the cover is formed from a cover resin composition mainly comprising a mixture of (a) ionomer resin, and (b) a functional group modified polyester-based thermoplastic elastomer as a base resin.

In order to put the present invention into a more suitable practical application, it is desired that is the functional group modified polyester-based thermoplastic elastomer be modified by a functional group selected from the group consisting of epoxy group, acid group, ester group, hydroxyl group and anhydride group:

the functional group modified polyester-based thermoplastic elastomer have a Shore D hardness of not more than 50;

the cover resin composition have a Shore D hardness of 50 to 67, and the cover have a thickness of 0.5 to 2.5 mm; and a weight ratio (a/b) of the ionomer resin (a) to the functional group modified polyester-based thermoplastic elastomer (b) be within the range of 40/60 to 95/5.

DETAILED DESCRIPTION OF THE INVENTION

The golf ball of the present invention comprises a core and a cover covering the core. The core is formed from a rubber composition essentially containing a base rubber, a co-crosslinking agent, an organic peroxide, a filler, an antioxidant and the like. The core may have single-layered structure or multi-layered structure, which has two or more layers.

The base rubber used for the core of the present invention may be synthesis rubber, which has been conventionally used for cores of solid goof balls. Preferred is high-cis polybutadiene rubber containing a cis-1, 4 bond of not less than 40%, preferably not less than 80%. The high-cis polybutadiene rubber may be optionally mixed with natural rubber, polyisoprene rubber, styrene-butadiene rubber, ethylene-propylene-diene rubber (EPDM) and the like.

The co-crosslinking agent car be a metal salt of α,β-unsaturated carboxylic acid, including mono or divalent metal salts, such as zinc or magnesium salts of α,β-unsaturated carboxylic acids having 3 to 8 carbon atoms (e.g. acrylic acid, methacrylic acid, etc.), or a blend of the metal salt of α,β-unsaturated carboxylic acid and acrylic ester or methacrylic ester and the like. When the core has two-layered structure composed of an inner core and an outer core, and the outer core has small thickness, the preferred co-crosslinking agent for the inner core is a zinc salt of α,β-unsaturated carboxylic acid, particularly zinc acrylate because it imparts high rebound characteristics to the resulting golf ball, and the preferred co-crosslinking agent for the outer core is a magnesium salt of α,β-unsaturated carboxylic acid, particularly magnesium methacrylate because it imparts good releasability from a mold to the core. The amount of the co-crosslinking agent is from 15 to 55 parts by weight, preferably from 18 to 50 parts by weight, more preferably from 20 to 48 parts by weight, based on 100 parts by weight of the base rubber. When the amount of the co-crosslinking agent is larger than 55 parts by weight, the core is too hard, and the shot feel of the resulting golf ball is poor. On the other hand, when the amount of the co-crosslinking agent is smaller than 15 parts by weight, it is required to increase an amount of the organic peroxide in order to impart a desired hardness to the core. Therefore, the rebound characteristics are degraded, which reduces the flight distance.

The organic peroxide, which acts as a crosslinking agent or hardener, includes, for example, dicumyl peroxide, 1,1-bis (t-butylperoxy)-3,3,5-trimethylcyclohexane, 2,5-dimethyl-2,5-di(t-butylperoxy) hexane, di-t-butyl peroxide and the like. The preferred organic peroxide is dicumyl peroxide. The amount of the organic peroxide is from 0.3 to 5.0 parts by weight, preferably 0.4 to 3.0 parts by weight, based on 100 parts by weight of the base rubber. When the amount of the organic peroxide is smaller than 0.3 parts by weight, the core is too soft, and the rebound characteristics of the resulting golf ball are degraded, which reduces the flight distance. On the other hand, when the amount of the organic peroxide is larger than 5.0 parts by weight, the core is too hard, and the shot feel of the resulting golf ball is poor.

The filler, which can be typically used for the core of solid golf ball, includes for example, inorganic filler (such as zinc oxide, barium sulfate, calcium carbonate and the like), high specific gravity metal powder filler (such as tungsten powder, molybdenum powder and the like), and the mixture thereof. The amount of the filler is from 0.5 to 30.0 parts by weight, preferably from 1.0 to 20.0 parts by weight, based on 100 parts by weight of the base rubber. When the amount of the filler is smaller than 0.5 parts by weight, it is difficult to adjust the proper weight of the resulting golf ball. On the other hand, when the amount of the filler is larger than 30.0 parts by weight, the weight ratio of the rubber component in the core is small, and the rebound characteristics reduce too much.

The rubber compositions for the core of the golf ball of the present invention can contain other components, which have been conventionally used for preparing the core of solid golf balls, such as organic sulfide compound, antioxidant and the like. If used, the amount of the organic sulfide compound is preferably 0.1 to 5.0 parts by weight, based on 100 parts by weight of the base rubber.

The core of the golf ball of the present invention can be obtained by mixing the rubber composition, and then press-molding and vulcanizing the mixture under applied heat in a mold. The vulcanizing, of which the condition is not limited, is conducted at 130 to 180° C. and 2.9 to 11.8 MPa for 10 to 40 minutes.

When the core has multi-layered structure, such as two-layered structure composed of the inner core and outer core, the both layer are preferably formed from the above rubber composition, but a material for the outer core is not limited as long as it has the above properties. That is, the outer core may be formed from the above rubber composition comprising cis-1,4-polybutadiene as a base rubber, or from thermoplastic res n, such as ionomer resin, thermoplastic elastomer or mixture thereof.

In the golf ball of the present invention, it is suitable for the core to have a diameter of 37.8 to 40.8 mm, preferably 38.8 to 40.8 mm, more preferably 39.2 to 40.4 mm. When the diameter of the core is smaller than 37.8 mm, the cover is too thick, and the resulting golf ball is hard. On the other hand, when the diameter is larger than 40.8 mm, the thickness of the cover is too thin, and the durability of the resulting golf ball is poor.

In the golf ball of the present invention, it is desired for the core to have a deformation amount when applying from an initial load of 98 N to a final load of 1275 N of 3.0 to 5.0 mm, preferably 3.1 to 4.8 mm, more preferably 3.4 to 4.7 nm. When the deformation amount is smaller than 3.0 mm, the shot feel of the resulting golf ball is hard and poor. On the other hand, when the deformation amount is larger than 5.0 mm, the deformation amount of the core at the time of hitting is too large, and the shot feel of the resulting golf ball is heavy and poor. In addition, the durability of the resulting golf ball is poor.

In the golf ball of the present invention, if the core has multi-layered structure, such as two-layered structure composed of an inner core and an outer core, it is desired that the diameter and deformation amount of the resulting two-layered core be within the above ranges. A method of producing the two-layered core is not specifically limited, but may be a conventional method. The spherical inner core can be obtained by mixing the rubber composition for the inner core, and then press-molding and vulcanizing the mixture at the above vulcanization condition in a mold. The two-layered core, which is formed by covering the outer core on the inner core, can be obtained by mixing the rubber composition for the outer core is mixed, coating the mixture on the inner core into a concentric sphere, and then press-molding at 160 to 180° C. for 10 to 20 minutes in the mold.

When the core has two-layered structure composed of an inner core and an outer core, the thickness of the outer core is determined by specifying the diameter of the inner core and that of the two-layered core, but it is desired for the outer core to have a thickness of 0.5 to 4.0 mm, preferably 0.8 to 3.5 mm, more preferably 1.0 to 3.0 mm. When the thickness of the outer core is smaller than 0.5 mm, it is difficult to mold it. On the other hand, when the thickness of the outer core is larger than 4.0 mm, the outer core is too thick in order to accomplishing the hardness distribution such that the outer portion is hard and the inner portion is soft, and the shot feel is hard and poor.

The cover is then covered on the core. In the golf ball of the present invention, it is required for the cover to be formed from a cover resin composition mainly comprising a mixture of (a) ionomer resin, and (b) a functional group modified polyester-based thermoplastic elastomer as a base resin. The wording "mainly comprising the mixture" as used herein means that the amount (a+b) of the mixture is not less than 50% by weight, preferably 80% by weight, more preferably 90% by weight.

The ionomer resin as the component (a) may be a copolymer of ethylene and α,β-unsaturated carboxylic acid having 3 to 8 carbon atoms, of which a portion of carboxylic acid groups is neutralized with metal ion; a terpolymer of ethylene, α,β-unsaturated carboxylic acid having 3 to 8 carbon atoms and α,β-unsaturated carboxylic acid ester, of which a portion of carboxylic acid groups is neutralized with metal ion: or mixtures thereof. Examples of the α,β-unsaturated carboxylic acid in the ionomer resin include acrylic acid, methacrylic acid, fumaric acid, maleic acid, crotonic acid and the like, and preferred are acrylic acid and methacrylic acid. Examples of the α,β-unsaturated carboxylic acid ester in the ionomer include methyl ester, ethyl ester, propyl ester, n-butyl ester and isobutyl ester of acrylic acid, methacrylic acid, fumaric acid, maleic acid, crotonic acid and the like. Preferred are acrylic acid esters and methacrylic acid esters. The metal ion which neutralizes a portion of carboxylic acid groups of the copolymer or terpolymer includes an alkali metal ion, such as a sodium ion, a potassium ion, a lithium ion and the like; a divalent metal ion, such as a zinc ion, a calcium ion, a magnesium ion and the like; a trivalent metal ion, such as an aluminum ion, a neodymium ion and the like; and mixture thereof. Preferred are sodium ions, zinc ions, lithium ions and the like, in view of rebound characteristics, durability and the like.

The ionomer resin is not limited, but examples thereof will be shown by a trade name thereof. Examples of the ionomer resins, which are commercially available from Du Pont-Mitsui Polychemicals Co., Ltd. include Hi-milan 1555 (Na), Hi-milan 1557 (Zn), Hi-milan 1605 (Na), Hi-milan 1706 (Zn), Hi-milan 1707 (Na) and Hi-milan AM7311 (Mg) as copolymer ionomer resin; Hi-milan 1856 (Na) and Hi-milan 1855 (Zn) as terpolymer ionomer resin; and the like.

Examples of the ionomer resin, which is commercially available from Du Pont Co., include Surlyn 8945 (Na), Surlyn 9945 (Zn), Surlyn 8940 (Na), Surlyn 8140 (Na), Surlyn 8150 (Na), Surlyn 9120 (Zn), Surlyn 9150 (Zn), Surlyn 6910 (Mg), Surlyn 6120 (Mg), Surlyn 7930 (Li), Surlyn 7940 (Li) and Surlyn AD8546 (Li) as copolymer ionomer resin; Surlyn 8120 (Na), Surlyn 8320 (Na), Surlyn 9320 (Zn) and Surlyn 6320 (Mg) as terpolymer ionomer resin; and the like.

Examples of the ionomer resin, which is commercially available from Exxon Mobil Chemical Co., Ltd., include Iotek 8000 (Na), Iotek 8030 (Na), Iotek 7010 (Zn) and Iotek 7030 (Zn) as copolymer ionomer resin; Iotek 7510 (Zn) and Iotek 7520 (Zn) as terpolymer ionomer resin; and the like.

Incidentally, Na, Zn, K, Li and Mg, which are described in parentheses after the trade name of the above ionomer resin, indicate their neutralizing metal ion species. These ionomer resins may be used alone or in combination of two or more thereof, or a mixture of one or more of the ionomer resin obtained by neutralizing with monovalent metal ion and the ionomer resin obtained by neutralizing with divalent metal ion, as the base resin of the cover in the present invention.

In the golf ball of the present invention, the base resin of the cover is used by mixing the functional group modified polyester-based thermoplastic elastomer as the component (b) with the ionomer resin as the component (a). The soft polyester-based thermoplastic elastomer is added to the ionomer resin having excellent rebound characteristics to improve the shot feel. In addition, the polyester-based thermoplastic elastomer is functional group modified to improve the compatibility with the ionomer resin as the component (a), and the laminar separation resistance described above can be improved.

Examples of the polyester-based thermoplastic elastomers include polyester ether-based thermoplastic elastomer, which is copolymer containing aromatic polyester polymeric unit as hard segment and aliphatic polyether polymeric unit as soft segment; polyester ester-based thermoplastic elastomer, which is copolymer containing aromatic polyester polymeric unit as hard segment and aliphatic polyester polymeric unit as soft segment; and the like. Concrete examples thereof include "Perprene (trade name)" commercially available from Toyobo Co., Ltd., "Hytrel (trade name)" commercially available from Toray-Do Pont Co., Ltd. and the like.

The functional group modified polyester-based thermoplastic elastomer as the component (b) is preferably the above polyester-based thermoplastic elastomer modified by a functional group selected from the group consisting of epoxy group, acid group, ester group, hydroxyl group and anhydride group. Preferred are polyester-based thermoplastic elastomers modified by epoxy group and anhydride group in view of the compatibility with the ionomer resin.

It is desired that a weight ratio (a/b) of the ionomer resin (a) to the functional group modified polyester-based thermoplastic elastomer (b) be within the range of 40/60 to 95/5, preferably 50/50 to 95/5, more preferably 60/40 to 95/5. When the amount of the ionomer resin (a) is smaller than 40% by weight, the cover hardness is low, and the rebound characteristics of the resulting golf ball are degraded. On the other hand, when the amount of the ionomer resin (a) is larger than 95% by weight, the technical effects accomplished by the presence of the functional group modified polyester-based thermoplastic elastomer (b) are not sufficiently obtained.

It is desired for the ionomer resin (a) to have a hardness in Shore D hardness of 50 to 70, preferably 52 to 65, more preferably 55 to 63. When the hardness of the ionomer resin is lower than 50, a desired hardness of the blend with the component (b) is not obtained. On the other hand, when the hardness of the ionomer resin (a) is higher than 70, the cover is too hard, and the shot feel of the resulting golf ball is poor.

It is desired for the functional group modified polyester-based thermoplastic elastomer (b) to have a hardness in Shore D hardness of not more than 50, preferably 5 to 40, more preferably 10 to 30. When the hardness of the functional group modified polyester-based thermoplastic elastomer is higher than 50, it is difficult to soften the cover. On the other hand, when the hardness is lower than 5, it is too soft, and it is difficult to prepare as a cover material.

In the golf ball of the present invention, the cover resin composition may optionally contain pigments (such as titanium dioxide, etc.) and the other additives such as a dispersant, an antioxidant, a UV absorber, a photostabilizer and a fluorescent agent or a fluorescent brightener, etc., in addition to the above resin component as long as the addition of the additives does not deteriorate the desired performance of the golf ball cover. If used, the amount of the pigment is preferably 0.1 to 5 parts by weight, based on 100 parts by weight of the resin component for the cover.

A method of covering on the core with the cover is not specifically limited, but may be a conventional method. For example, there can be used a method comprising molding the cover composition into a semi-spherical half-shell in advance, covering the core with the two half-shells, followed by press molding at 160 to 200° C. for 1 to 10 minutes, or a method comprising injection molding the cover composition directly on the core, which is covered with the cover, to cover it. Preferred is the method comprising injection molding in view of the moldability of the cover.

In the golf ball of the present invention, it is desired for the cover to have a thickness of 0.5 to 2.5 mm, preferably 1.0 to 2.0 mm, more preferably 1.2 to 1.8 mm. When the thickness is smaller than 0.5 mm, the cover is too thin, and the durability of the resulting golf ball is poor. On the other hand, when the thickness is larger than 2.5 mm, the cover is too thick, and the rebound characteristics of the resulting golf ball are degraded, which reduces the flight distance.

In the golf ball of the present invention, it is desired for the cover resin composition to have a Shore D hardness of 50 to 67, preferably 52 to 67, more preferably 55 to 65. When the hardness is lower than 50, the rebound characteristics are degraded, which reduces the flight distance. On the other hand, when the hardness is higher than 67, the durability is poor. The term "a hardness of the cover resin composition" as used herein refers to the hardness (slab hardness) measured using a sample of a heat and press molded sheets from the cover composition.

At the time of molding the cover, many depressions called "dimples" may be formed on the surface of the golf ball. Furthermore, paint finishing or marking with a stamp may be optionally provided after the cover is molded for commercial purposes.

In the golf ball of the present invention, it is desired to have a deformation amount when applying from an initial load of 98 N to a final load of 1275 N of 2.7 to 4.0 mm, preferably 2.8 to 3.9 mm, more preferably 2.9 to 3.8 mm. When the deformation amount is smaller than 2.7 mm, the shot feel is hard and poor. On the other hand, when the deformation amount is larger than 4.0 mm, the deformation amount at the time of hitting is too large and the shot feel is heavy and poor.

The golf ball of the present invention is formed, so that it has a diameter of not less than 42.67 mm (preferably 42.67 to 43 mm) and a weight of not more than 45.93 g, in accordance with the regulations for golf balls.

The diameter of golf balls is limited to not less than 42.67 mm in accordance with the regulations for golf balls as described above. Generally, when the diameter of the golf ball is large, air resistance of the golf ball on a flight is large, which reduces the flight distance. Therefore, most of golf balls commercially available are designed to have a diameter of 42.67 to 42.82 mm. The present invention is applicable to the golf balls having the diameter. There are golf balls having large diameter in order to improve the easiness of hitting. In addition, there are cases where golf balls having a diameter out of the regulations for golf balls are required depending on the demand and object of users. Therefore, it can be considered for golf balls to have a diameter of 42 to 44 mm, more widely 40 to 45 mm. The present invention is also applicable to the golf balls having the diameter. In addition, the golf ball of the present invention has a weight of 44 to 46 g, preferably 45.00 to 45.93 g.

EXAMPLES

The following Examples and Comparative Examples further illustrate the present invention in detail but are not to be construed to limit the scope of the present invention.

Production of Core (Core 1) Single-Layer Structured Core

The rubber composition for the core having the formulation shown in Table 1 was mixed, and then vulcanized by press-molding in the mold at the vulcanization condition shown in the same Table to obtain spherical core having a diameter of 39.4 mm.

(Cores II and III) Two-Layer Structured Core (i) Production of Inner Core

The rubber composition for the inner core having the formulation shown in Table 1 was mixed, and then vulcanized by press-molding in the mold at the vulcanization condition shown in the same Table to obtain spherical inner core.

(ii) Production of Two-Layer Structured Core

The rubber composition for the outer core having the formulation shown in Table 1 was mixed, and coated on the inner core produced in the step (i) into a concentric sphere, and then vulcanized by press-molding in the mold at the vulcanization condition shown in the same Table to obtain spherical two-layer structured core having a diameter of 39.4 mm.

The deformation amount of the resulting core was measured, and the results is shown in the same Table.

TABLE 1

| | (parts by weight) | | |
|---|---|---|---|
| Core | I | II | III |
| (Inner core composition) | | | |
| BR-18 *1 | 100 | 100 | 100 |
| Zinc acrylate | 31.0 | 28.5 | 24.0 |
| Zinc oxide | 18.0 | 18.6 | 20.2 |
| Dicumyl peroxide *2 | 0.6 | 0.6 | 0.6 |
| Diphenyl disulfide *3 | 1.0 | 0.5 | 0.5 |
| Vulcanization condition | | | |
| Temp. (° C.) | 170 | 170 | 170 |
| Time (min) | 15 | 15 | 15 |
| (Outer core composition) | | | |
| BR-18 *1 | — | 100 | 100 |
| Magnesium methacrylate | — | 45.0 | 45.0 |
| Magnesium oxide | — | 35.6 | 35.6 |
| Dicumyl peroxide *2 | — | 5.0 | 5.0 |
| Vulcanization condition | | | |
| Temp. (° C.) | — | 155 | 155 |
| Time (min) | — | 25 | 25 |
| Core deformation amount (mm) | 3.90 | 4.30 | 4.70 |

*1: High-cis polybutadiene commercially available from JSR Co., Ltd., under the trade name "BR-18" (Content of cis-1,4-polybutadiene=96%)
*2: Dicumyl peroxide, commercially available from Nippon Oil & Fats Co., Ltd. under the trade name of "Percumyl D"
*3: Diphenyl disulfide commercially available from Sumitomo Seika Co., Ltd.

Preparation of Cover Compositions

The formulation materials for the cover showed in Table 2 were mixed using a kneading type twin-screw extruder to obtain pelletized cover compositions. The extrusion condition was, a screw diameter of 45 mm, a screw speed of 200 rpm, a screw L/D of 35.

The formulation materials were heated at 200 to 260° C. at the die position of the extruder. The hardness were determined, using a sample of a stack of the three or more heat and press molded sheets having a thickness of about 2 mm from the cover composition, which had been stored at 23° C. for 2 weeks, with a Shore D hardness meter according to ASTM D 2240. The results are shown as cover hardness (slab hardness) in Tables 2 to 4. The test method is as described later.

TABLE 2

| | | | | | | | (parts by weight) |
|---|---|---|---|---|---|---|---|
| Cover composition | A | B | C | D | E | F | G |
| Surlyn 8945 *4 | 45 | 40 | 40 | — | 45 | 45 | — |
| Surlyn 9945 *5 | 45 | 40 | 40 | — | 45 | 45 | — |
| Surlyn 8140 *6 | — | — | — | 40 | — | — | 50 |
| Surlyn 9120 *7 | — | — | — | 40 | — | — | 50 |
| Epoxy modified polyester-based elastomer-1 *8 | 10 | 20 | — | 20 | — | — | — |

TABLE 2-continued

| Cover composition | A | B | C | D | E | F | G |
|---|---|---|---|---|---|---|---|
| | | | | | (parts by weight) | | |
| Epoxy modified polyester-based elastomer-2 *9 | — | — | 20 | — | — | — | — |
| Perprene P40B *10 | — | — | — | — | 10 | — | — |
| Epofriend A1010 *11 | — | — | — | — | — | 10 | — |
| Titanium dioxide | 2 | 2 | 2 | 2 | 2 | 2 | 2 |
| Cover hardness (Shore D) | 60 | 56 | 58 | 58 | 59 | 60 | 70 |

*4: Surlyn 8945 (trade name), ethylene-methacrylic acid copolymer ionomer resin obtained by neutralizing with sodium ion, manufactured by Du Pont Co., Shore D hardness: 65
*5: Surlyn 9945 (trade name), ethylene-methacrylic acid copolymer ionomer resin obtained by neutralizing with zinc ion, manufactured by Du Pont Co., Shore D hardness: 62
*6: Surlyn 8140 (trade name), ethylene-methacrylic acid copolymer ionomer resin obtained by neutralizing with sodium ion, manufactured by Du Pont Co., Shore D hardness: 70
*7: Surlyn 9120 (trade name), ethylene-methacrylic acid copolymer ionomer resin obtained by neutralizing with zinc ion, manufactured by Du Pont Co., Shore D hardness: 69
*8: Perprene P-20BG-X2, epoxy modified polyester-based thermoplastic elastomer commercially available from Toyobo Co., Ltd., Shore D hardness: 15
*9: Perprene P-40HG-X2, epoxy modified polyester-based thermoplastic elastomer commercially available from Toyobo Co., Ltd., Shore D hardness: 33
*10: Perprene P40B (trade name), polyester-based thermoplastic elastomer commercially available from Toyobo Co., Ltd., Shore D hardness: 31
*11: Epofriend A1010 (trade name), styrene-butadiene-styrene (SBS) block copolymer with epoxy groups, manufactured by Daicel Chemical Industries, Ltd., JIS-A hardness: 70

Examples 1 to 6 and Comparative Examples 1 to 3

The cover composition was covered on the core obtained as described above by directly injection molding to form a cover layer having a thickness of 17 mm. Then, clear paint was coated on the surface of the cover layer after deflashing to obtain a golf ball having a diameter of 42.8 mm and a weight of 45.4 g. With respect to the resulting golf balls, the deformation amount, coefficient of restitution, flight distance, shot feel and laminar separation resistance were measured or evaluated. The results are shown in Table 3 (Examples) and Table 4 (Comparative Examples). The test methods are as follows.

(Test Methods)

(1) Deformation Amount

The deformation amount was determined by measuring a deformation amount, when applying from an initial load of 98 N to a final load of 1275 N on the core or golf ball.

(2) Cover Hardness (Slab Hardness)

The cover hardness was determined by measuring a Shore D hardness, using a sample of a stack of the three or more heat and press molded sheets having a thickness of about 2 mm from the cover composition, which had been stored at 23° C. for 2 weeks. The Shore D hardness was measured by using an automatic rubber hardness tester (type LAl), which is commercially available from Kobunshi Keiki Co., Ltd., with a Shore D hardness meter according to ASTM D 2240.

(3) Coefficient of Restitution

An aluminum cylinder having a weight of 200 g was struck at a speed of 45 m/sec against a golf ball, and the velocity of the cylinder and the golf ball after the strike were measured. The coefficient of restitution of the golf ball was calculated from the velocity and the weight of both the cylinder and golf ball before and after strike. The measurement was conducted 5 times for each golf ball (n=5), and the average is indicated by an index when that of Example 6 is 100 as the result of the golf ball.

(4) Flight Distance

A No.1 wood club (a driver) commercially available was mounted to a swing robot manufactured by True Temper Co. and the resulting golf ball was hit at a head speed of 40 m/second, flight distance was measured. As the flight distance, total that is a distance to the stop point of the hit golf ball was measured. The measurement was conducted 5 times for each golf ball (n=5), and the average is indicated by an index when that of Example 6 is 100 as the result of the golf ball.

(5) Laminar Separation Resistance

After a pitching wedge (PW) commercially available was mounted to a swing robot manufactured by True Temper Co., two points on the surface of each golf ball was hit at a head speed of 36 m/sec one time for each point. The two points were evaluated by checking the surface appearance by visual observation. The evaluation criteria are as follows.

Evaluation Criteria x: The laminar separation occurs at the two hot point having a cut on the surface of the golf ball.

○: The laminar separation does not occurs at the two hot point having a cut on the surface of the golf ball.

(6) Shot Feel

The shot feel of the resulting golf balls was evaluated by 10 golfers, who swing a golf club at a head speed of 40 m/second, according to practical hitting test using a No.1 wood club (W#1, a driver). The evaluation criteria are as follows.

(Evaluation Criteria)

○: Not less than 6 golfers out of 10 golfers felt that the golf ball has soft and good shot feel such that the impact force at the time of hitting is small and the rebound characteristics are good.

Δ: Three to 5 golfers out of 10 golfers felt that the golf ball has soft and good shot feel such that the impact force at the time of hitting is small and the rebound characteristics are good.

x: Not more than 2 golfers out of 10 golfers felt that the golf ball has soft and good shot feel such that the impact force at the time of hitting is small and the rebound characteristics are good.

(Test Results)

TABLE 3

| Test item | Example No. 1 | 2 | 3 | 4 | 5 | 6 |
|---|---|---|---|---|---|---|
| | | | (Core) | | | |
| Type | I | II | II | II | II | III |
| Deformation amount (mm) | 3.90 | 4.30 | 4.30 | 4.30 | 4.30 | 4.70 |
| | | | (Cover) | | | |
| Type | A | A | B | C | D | A |
| Cover hardness | 60 | 60 | 56 | 58 | 58 | 60 |
| | | | (Golf ball) | | | |
| Deformation amount (mm) | 2.90 | 3.30 | 3.45 | 3.35 | 3.28 | 3.60 |
| Coefficient of restitution | 104 | 102 | 101 | 102 | 103 | 100 |
| Flight distance | 103 | 102 | 101 | 101 | 103 | 100 |
| Shot feel | ○ | ○ | ○ | ○ | ○ | ○ |

TABLE 3-continued

| Test item | Example No. 1 | 2 | 3 | 4 | 5 | 6 |
|---|---|---|---|---|---|---|
| Laminar separation resistance | ○ | ○ | ○ | ○ | ○ | ○ |

TABLE 4

| Test item | Comparative Example No. 1 | 2 | 3 |
|---|---|---|---|
| (Core) | | | |
| Type | II | II | II |
| Deformation amount (mm) | 4.30 | 4.30 | 4.30 |
| (Cover) | | | |
| Type | E | F | G |
| Cover hardness | 59 | 60 | 70 |
| (Golf ball) | | | |
| Deformation amount (mm) | 3.33 | 3.29 | 2.60 |
| Coefficient of restitution | 98 | 98 | 105 |
| Flight distance | 98 | 98 | 104 |
| Shot feel | ○ | ○ | x |
| Laminar separation resistance | x | x | ○ |

As is apparent from the results of tables 3 to 4, the golf balls of the present invention of examples 1 to 6, when compared with the golf balls of comparative examples 1 to 3, are superior in rebound characteristics, flight distance, shot feel and laminar separation resistance.

On the other hand, in the golf ball of comparative Example 1, since the mixture of ionomer resin and functional group free polyester-based thermoplastic elastomer is used as the base resin for the cover, the shot feel is excellent, but the laminar separation resistance is poor.

In the golf ball of Comparative Example 2, since the mixture of ionomer resin, functional group free polyester-based thermoplastic elastomers and epoxidized diene block copolymer is used as the base resin for the cover, the shot feel is excellent, but the laminar separation resistance is poor.

In the golf ball of Comparative Example 3, since soft components are not used as the base resin for the cover, the rebound characteristics, flight distance and laminar separation resistance are excellent, but the shot feel is poor.

What is claimed is:

1. A golf ball comprising at least one layer of a core and a cover formed on the core, wherein the cover is formed from a cover resin composition mainly comprising a mixture of:

(a) ionomer resin, and (b) a functional group modified polyester-based thermoplastic elastomer as a base resin, and wherein the cover resin composition has a Shore D hardness of 50 to 67, and the cover has a thickness of 0.5 to 2.5 mm.

2. The golf ball according to claim 1, wherein the functional group modified polyester-based thermoplastic elastomer is modified by a functional group selected from the group consisting of epoxy group, acid group, ester group, hydroxyl group and anhydride group.

3. The golf ball according to claim 1, wherein the functional group modified polyester-based thermoplastic elastomer has a Shore D hardness of not more than 50.

4. The golf ball according to claim 1, wherein a weight ratio (a/b) of the ionomer resin (a) to the functional group modified polyester-based thermoplastic elastomer (b) is within the range of 40/60 to 95/5.

5. The golf ball according to claim 2, wherein functional group modified polyester-based thermoplastic elastomer has a Shore D hardness of not more than 50.

6. The golf ball according to claim 5, wherein a weight ratio (a/b) of the ionomer resin (a) to the functional group modified polyester-based thermoplastic elastomer (b) is within the range of 40/60 to 95/5.

7. The golf ball according to claim 1, wherein the mixture is present in the cover resin composition in an amount not less than 80% by weight.

8. The golf ball according to claim 1, wherein the mixture is present in the cover resin composition in an amount not less than 90% by weight.

9. The golf ball according to claim 1, wherein a weight ratio (a/b) of the ionomer resin (a) to the functional group modified polyester-based thermoplastic elastomer (b) is within the range of 50/50 to 95/5.

10. The golf ball according to claim 1, wherein a weight ratio (a/b) of the ionomer resin (a) to the functional group modified polyester-based thermoplastic elastomer (b) is within the range of 60/40 to 95/5.

11. The golf ball according to claim 1, wherein the ionomer resin has a Shore D hardness of 50 to 70.

12. The golf ball according to claim 1, wherein the ionomer resin has a Shore D hardness of 55 to 63.

13. The golf ball according to claim 1, wherein the functional group modified polyester-based thermoplastic elastomer has a Shore D hardness of 5 to 40.

14. The golf ball according to claim 1, wherein the functional group modified polyester-based thermoplastic elastomer has a Shore D hardness of 10 to 30.

15. The golf ball according to claim 1, wherein the cover resin composition has a Shore D hardness of 52 to 67.

16. The golf ball according to claim 1, wherein the cover resin composition has a Shore D hardness of 55 to 65.

17. The golf ball according to claim 1, wherein the functional group modified polyester-based thermoplastic elastomer is modified by a functional group selected from the group consisting of epoxy group and anhydride group.

* * * * *